US005634172A

United States Patent [19]

Manabe

[11] Patent Number: 5,634,172

[45] Date of Patent: May 27, 1997

[54] IMAGE FORMING APPARATUS COMPRISING A ROTATABLE WASTE TONER CONTAINER HAVING A LOCKING MECHANISM FOR LOCKING A DRIVE MECHANISM

[75] Inventor: Nobuo Manabe, Yamatokoriyama, Japan

[73] Assignee: Sharp Kabushiki Kaisha, Osaka, Japan

[21] Appl. No.: 608,446

[22] Filed: Feb. 28, 1996

[30] Foreign Application Priority Data

Mar. 3, 1995 [JP] Japan ..... 7-044089

[51] Int. Cl.[6] ..... G03G 21/00

[52] U.S. Cl. ..... 399/35

[58] Field of Search ..... 355/298, 208, 355/260, 200, 211

[56] References Cited

U.S. PATENT DOCUMENTS

| | | | |
|---|---|---|---|
| 4,436,414 | 3/1984 | Kamiyama et al. | 355/298 |
| 4,730,205 | 3/1988 | Ogiri et al. | 355/298 |
| 5,047,803 | 9/1991 | Kanoto | 355/211 |
| 5,084,734 | 1/1992 | Yoshino et al. | 355/260 |
| 5,113,227 | 5/1992 | Miyasaka | 355/298 |
| 5,400,127 | 3/1995 | Arai et al. | 355/298 |

FOREIGN PATENT DOCUMENTS

| | | | |
|---|---|---|---|
| 61-114271 | 5/1986 | Japan | 355/298 |
| 5-045745 | 6/1993 | Japan . | |
| 7-319351A | 12/1995 | Japan . | |

OTHER PUBLICATIONS

Patent Abstracts of Japan, re 58-31368-A, Shimura, in English (copyright 1983).

Patent Abstracts of Japan, re 4-106577-A, Ko & Fukunaga, in English (copyright 1992).

*Primary Examiner*—Arthur T. Grimley
*Assistant Examiner*—Sophia S. Chen
*Attorney, Agent, or Firm*—David G. Conlin; Milton Oliver

[57] ABSTRACT

An image forming apparatus has a locking mechanism and a detecting switch. The locking mechanism locks a drive mechanism not to drive a waste toner container when no waste toner container is loaded in a predetermined place, and releases and thus allows the drive mechanism to drive the waste toner container when the waste toner container is loaded in the predetermined place. The detecting switch outputs, in response to the locking mechanism, a detection signal which varies depending on whether the waste toner container is loaded in the predetermined place. A transporting mechanism for transporting waste toner to the waste toner container is also locked in linkage with the locking mechanism. Consequently, the image forming apparatus has a simple structure and is low-cost and free from faulty operations in judging whether the waste toner container is loaded in the predetermined place and in preventing a faulty transportation of the waste toner to the waste toner container.

22 Claims, 3 Drawing Sheets

IMAGE FORMING APPARATUS COMPRISING A ROTATABLE WASTE TONER CONTAINER HAVING A LOCKING MECHANISM FOR LOCKING A DRIVE MECHANISM

FIELD OF THE INVENTION

The present invention relates to an image forming apparatus adopting an electrophotographic system, such as a copying machine and a printer, and more particularly to an image forming apparatus having a waste toner collecting device.

BACKGROUND OF THE INVENTION

Some conventional image forming apparatuses, in order to judge whether a waste toner container is loaded, detect weight of the waste toner container loaded in the loading place.

Some other conventional image forming apparatuses employ a drive torque for judging whether a waste toner container is full of waste toner. The drive torque, provided to transporting means for transporting used toner, detects the full waste toner container when amount of transported waste toner exceeds a predetermined value. An image forming apparatus of this type is disclosed in Japanese Laid-Open Patent Publication No. 4-106577/1992 (Tokukaihei 4-106577).

Some other conventional image forming apparatuses employ a shutter for preventing transported waste toner from falling into a waste toner collecting device when no waste toner container is loaded. The shutter, provided at the end of a toner transporting pipe close to the waste toner container, is closed when no waste toner container is loaded. An image forming apparatus of this type is disclosed in Japanese Laid-Open Patent Publication No. 58-31368/1983 (Tokukaishou 58-31368).

There are problems with the conventional image forming apparatus detecting the weight in order to judge whether the waste toner container is loaded. For example, when there is something of the same weight as the waste toner container in the loading place for some reason, the apparatus makes a misjudgement that the waste toner container is loaded, the misjudgement leading to a faulty operation. Besides, since the weight of the waste toner container varies depending on amount of the waste toner collected in the waste toner container, a complex and costly structure is needed for higher accuracy in the weight detection process. Also, there are problems with the conventional image forming apparatus which only judges whether the waste toner container is full of waste toner. For example, a separate detecting system is needed for judging whether the waste toner container is loaded in the loading place, and this makes the image forming apparatus more complex and costly. Also, there are problems with the conventional image forming apparatus employing the shutter. For example, since the shutter can only prevent transported waste toner from falling into the waste toner collecting device when no waste toner container is loaded, the shutter cannot stop the waste toner transportation itself. Therefore, the shutter cannot completely solve the problem that the waste toner is transported to the unloaded waste toner collecting device, and makes the image forming apparatus more complex and costly.

To sum up the above discussion, the conventional image forming apparatuses have common problems of faulty operation, a complex structure and a high cost.

SUMMARY OF THE INVENTION

It is an object of the present invention to provide an image forming apparatus having a low-cost waste toner transporting device capable of preventing faulty operations completely with a simple structure.

In order to accomplish the above object, an image forming apparatus in accordance with the present invention is characterized in that the image forming apparatus has a waste toner transporting device having at least the following components (1) to (5):

(1) a waste toner container capable of being loaded in a predetermined place;

(2) a drive source;

(3) a drive mechanism, driven by the drive source, for driving the waste toner container to rotate;

(4) a locking mechanism for locking the drive mechanism not to drive the waste toner container when no waste toner container is loaded in the predetermined place, and for releasing and thus allowing the drive mechanism to drive the waste toner container when the waste toner container is loaded in the predetermined place; and (5) detecting means for outputting, in response to the locking mechanism, a detection signal which varies depending on whether the waste toner container is loaded in the predetermined place.

The locking mechanism (4) is preferably pushed into a locking position for locking the drive mechanism not to drive the waste toner container when no waste toner container is loaded. Besides, the locking mechanism (4) is preferably pushed by the waste toner container into a position for releasing and thus allowing the drive mechanism to drive the waste toner container when the waste toner container is loaded in the predetermined place.

Moreover, the drive mechanism (3) preferably has a container drive gear having the following characteristics. The container drive gear is driven by the drive mechanism and drives the waste toner container to rotate. The container drive gear engages with the locking mechanism not to drive the waste toner container when no waste toner container is loaded. Besides, the container drive gear is pushed by an end of the waste toner container to be released from the locking mechanism and to be thus allowed to drive the waste toner container to rotate when the waste toner container is loaded in the predetermined place.

With the above arrangement, when no waste toner container is loaded in the predetermined place, the drive mechanism for driving the waste toner container to rotate is locked by the locking mechanism. The detecting means detects the locked drive mechanism and outputs a detection signal. Based on the detection signal, it is possible to stop transporting the waste toner to the waste toner container when no waste toner container is loaded. Therefore, it is possible to prevent the waste toner from being transported and making the predetermined loading place dirty when no waste toner container is loaded. In other words, the drive mechanism is locked by the locking mechanism in the present invention, whereas weight is measured in a conventional method in order to judge whether the waste toner container is loaded. Therefore, in the present invention, the detection is highly accurate and free from problems of low accuracy and a complex structure whereas the conventional weight detection method are not free from these problems.

In order to accomplish the above object, an image forming apparatus in accordance with the present invention is characterized in that the image forming apparatus has a waste toner transporting device having at least the following components (6) to (12):

(6) a waste toner container capable of being loaded in a predetermined place;
(7) at least one drive source;
(8) a transporting mechanism, driven by the drive source, for transporting waste toner to the waste toner container;
(9) a drive mechanism, driven by the drive source, for driving the waste toner container to rotate;
(10) a locking mechanism for locking the drive mechanism not to drive the waste toner container when no waste toner is loaded in the predetermined place;
(11) a responding mechanism for responding both when the locking mechanism locks the drive mechanism not to drive the waste toner container and when torque required for transporting the waste toner to the waste toner container by the transporting mechanism is not less than a predetermined value; and
(12) detecting means, in accordance with the responding mechanism, for detecting that no waste toner container is loaded and that amount of the waste toner in the waste toner container has reached predetermined amount.

The transporting mechanism and the drive mechanism are preferably driven by the same drive source (7).

With the arrangement, when no waste toner container is loaded in the predetermined place, the drive mechanism for driving the waste toner container to rotate is locked. The responding mechanism responds to the locked drive mechanism, and then the detecting means detects the unloaded waste toner container. Besides, as the responding mechanism responds, for example, to a full waste toner container measured by the torque of the waste toner transported to the waste toner container, the detecting means detects the full waste toner container. The detecting means thus functions in detecting both the full waste toner container and the unloaded waste toner container. This enables a simpler structure and a lower cost.

In order to accomplish the above object, an image forming apparatus in accordance with the present invention is characterized in that the image forming apparatus has a waste toner transporting device having at least the following components (13) to (18):
(13) a waste toner container capable of being loaded in a predetermined place;
(14) a drive source;
(15) a transporting mechanism, driven by the drive source for transporting waste toner to the waste toner container;
(16) a drive mechanism, driven by the drive source, for driving the waste toner container to rotate;
(17) a locking mechanism for locking the drive mechanism not to drive the waste toner container when no waste toner container is loaded in the predetermined place, and for releasing and thus allowing the drive mechanism to drive the waste toner container when the waste toner container is loaded in the predetermined place; and
(18) a linkage mechanism, interlocked with the locking mechanism, for locking the transporting mechanism not to transport the waste toner when the locking mechanism locks and stops the drive mechanism, and for releasing and thus allowing the transporting mechanism to transport the waste toner when the locking mechanism releases and thus allows the drive mechanism to drive the waste toner container.

With the arrangement, when no waste toner container is loaded, the transporting mechanism is locked not to transport the waste toner, and the waste toner is therefore not transported to the waste toner container. This, when no waste toner container is loaded, prevents the loading place from being made dirty by the waste toner which otherwise would be transported to and fall into the loading place. Besides, compared with a conventional method using a shutter, the present invention locks the transporting mechanism and therefore can keep the image forming device clean with a simpler structure and at a lower cost.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 through 4, the following description will discuss an embodiment of an image forming apparatus in accordance with the present invention. However, the embodiment is only illustrative and not restrictive. A copying machine is explained in the embodiment, but the scope of the present invention includes any apparatus adopting an electrophotographic system such as a printer.

Figure 1:
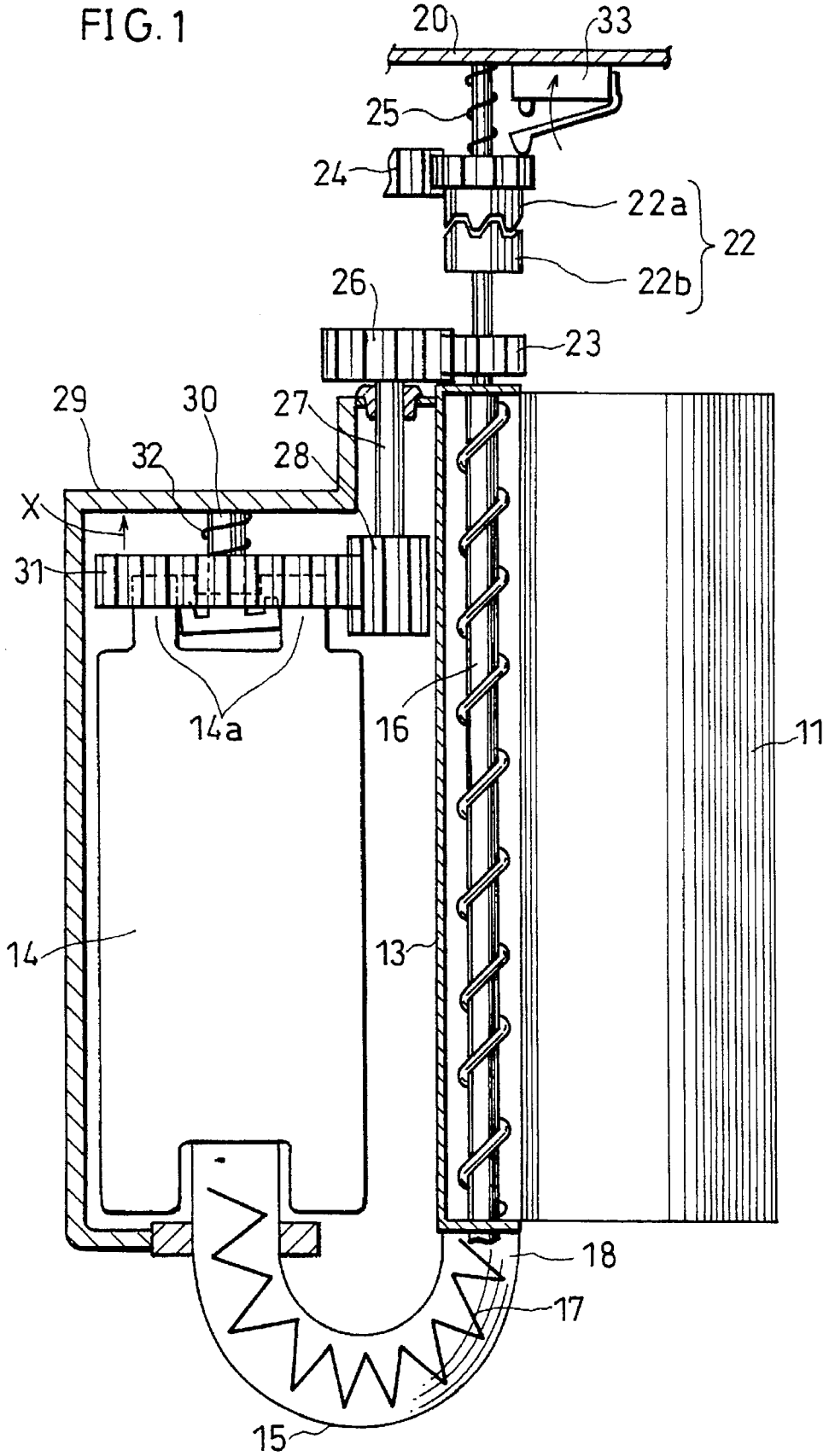
FIG. 1 is a schematic plan view showing an arrangement of main parts of an image forming apparatus of an embodiment in accordance with the present invention.
Figure 2:
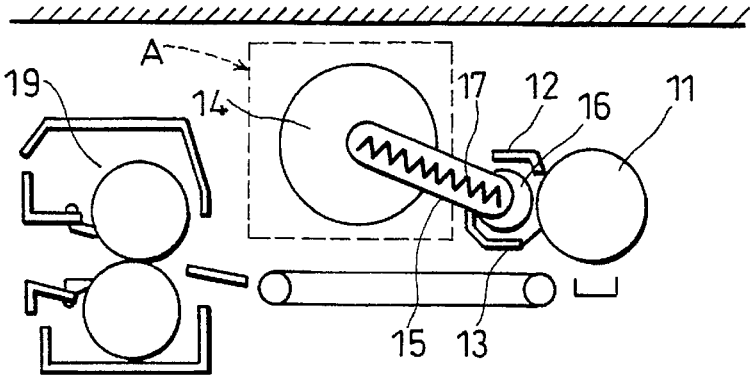
FIG. 2 is a schematic front view showing an arrangement of the embodiment.

FIGS. 1 and 2 are schematic plan and front views, respectively, showing an arrangement of main parts of a copying machine of the present embodiment in accordance with the present invention. Reference numerals in FIGS. 1 and 2 are explained hereafter. The member 11 is a photoreceptor drum. The member 12 is a cleaning blade for sweeping down residual waste toner on the photoreceptor drum 11. The member 13 is a cleaning section for receiving and temporarily keeping the waste toner swept down by the cleaning blade 12. The member 14 is a cylindrical waste toner container provided to be parallel to the cleaning section 13 and freely rotatable. The member 15 is a U-shaped waste toner transporting path linking an end of the cleaning section 13 and an opening of the waste toner container 14. The member 16 is a waste toner transporting screw for transporting the waste toner on the cleaning section 13. The member 17 is a waste toner transporting spring provided in the waste toner transporting path 15, one end of the waste toner transporting spring 17 being fixed to the waste toner screw 16, and the other end facing a free end of the waste toner transporting path 15. The member 18 is a spiral transporting body composed of the waste toner transporting screw 16 and the waste toner transporting spring 17. The member 19 is a fuser section.

The waste toner transporting path 15 and the spiral transporting body 18 constitute a transporting mechanism of the waste toner. The cleaning blade 12, the cleaning section 13 and the waste toner transporting screw 16 have the same length as a width of the photoreceptor drum 11. The waste toner transporting spring 17 rotates in synchronization with the waste toner transporting screw 16. The waste toner container 14 is provided in a relatively large space between the cleaning section 13 and the fuser section 19 (shown as a square A surrounded by doted lines in FIG. 2). Therefore, the waste toner container 14 of a large capacity can be adopted, thereby lengthening an exchange time-cycle of the waste toner container 14.

Figure 3:
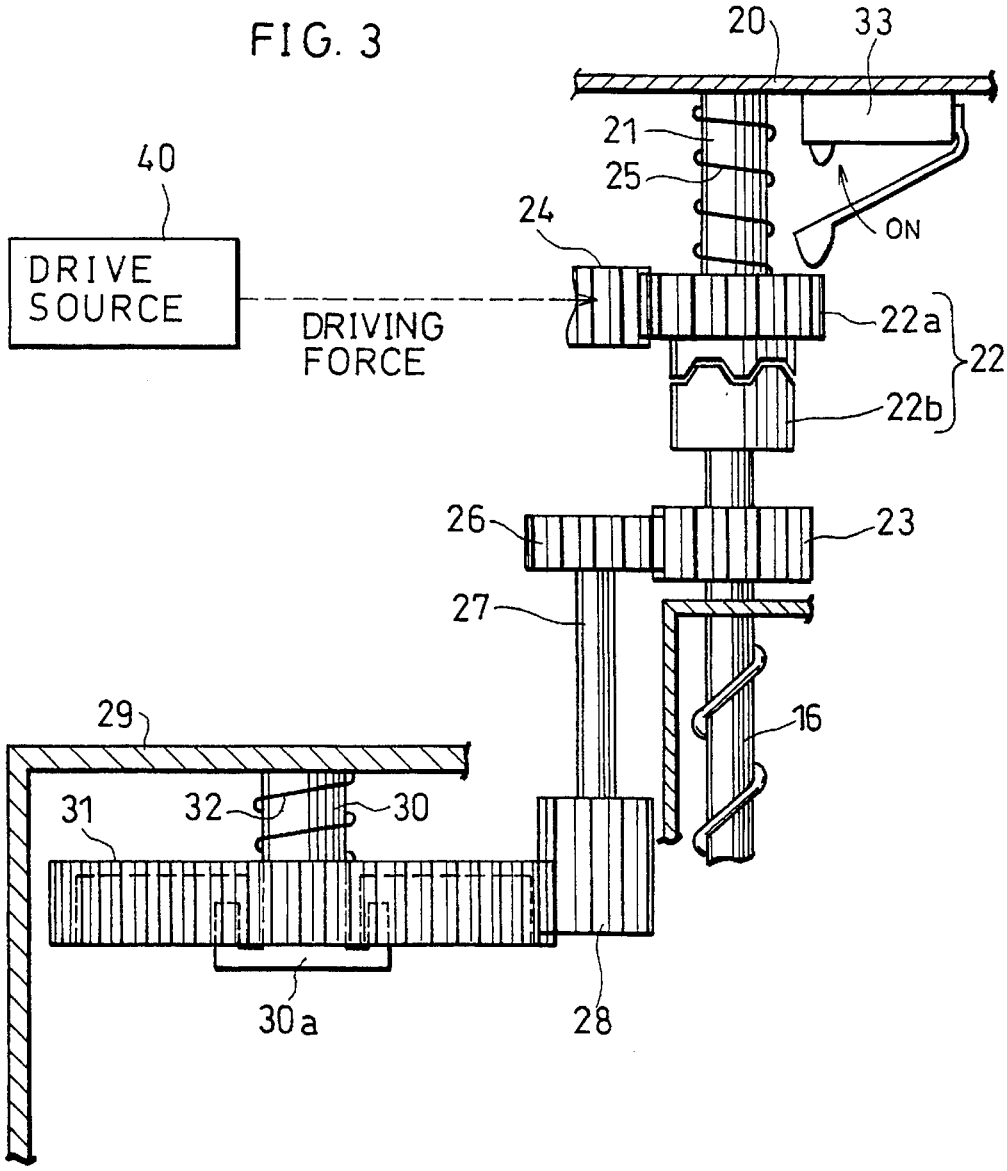
FIG. 3 is an enlarged plan view of the main parts of the embodiment.

As shown in the enlarged plan view of FIG. 3, a clutch section 22 serving as a responding and linkage mechanism is provided with a drive coupler 22*a* and a driven coupler 22*b* staying in mesh with each other. The clutch section 22 is supported by a supporting shaft 21 fixed to a drive frame 20. A gear provided around the drive coupler 22*a* stays in mesh with an input gear 24 driven to rotate by a drive source 40. The driven coupler 22*b* of the clutch section 22 is connected to a screw drive gear 23 of the waste toner transporting screw 16. The drive coupler 22*a* freely rotates around and slides along the supporting shaft 21. The drive coupler 22*a* is pushed towards the driven coupler 22*b* by a coupler spring 25 so that the drive and driven couplers 22*a* and 22*b* stay in mesh with each other. The screw drive gear 23 of the waste toner transporting screw 16 stays in mesh with a transmission gear 26. The transmission gear 26 and a transmission gear 28 are fixed to each other by a rotation shaft 27. As shown in FIG. 1, the rotation shaft 27 is supported by a frame 29 so as to be freely rotatable. The frame 29 also supports an end of the waste toner transporting path 15. A fixed shaft 30 is provided on the opposite end of the frame 29 from the waste toner transporting path 15. As shown in FIG. 3, a container drive gear 31 for driving the waste toner container 14 to rotate is provided to freely rotate around and slide along the fixed shaft 30. The screw drive gear 23, the transmission gears 26 and 28, and the container drive gear 31 provide a drive mechanism. The container drive gear 31 stays in mesh with the transmission gear 28. Therefore, the screw drive gear 23 and the container drive gear 31 are connected through the clutch section 22 and the input gear 24 to the same drive source 40 as the transporting mechanism is connected to.

Figure 4:
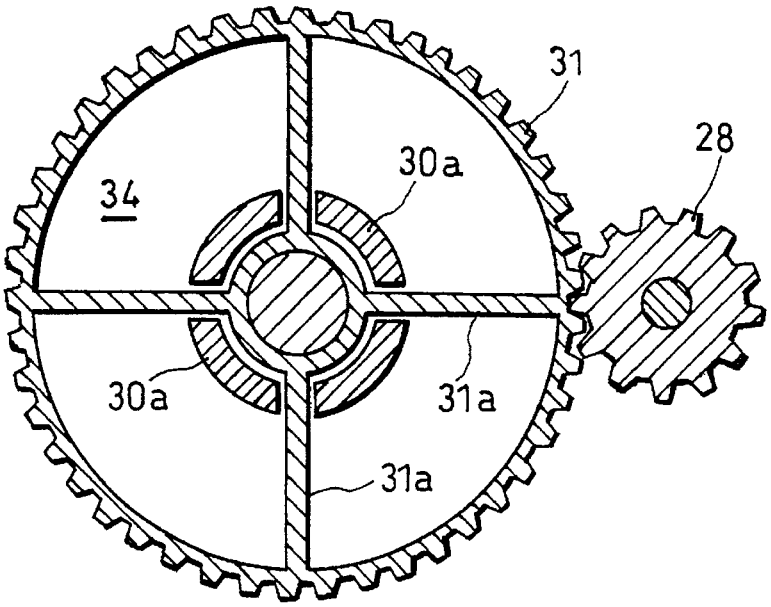
FIG. 4 is a cross-sectional view of the main parts of the embodiment.

As shown in the cross-sectional view of FIG. 4, a locking claw 30*a* is provided at an open end of the fixed shaft 30. The locking claw 30*a* has a shape of a cylinder divided into 4 parts. Ribs 31*a* are provided on the inner side of the container drive gear 31. The rib 31*a* freely engages with and disengages from the locking claw 30*a*. As shown in FIG. 3, the fixed shaft 30 is provided with a pushing spring 32 for pushing the container drive gear 31 towards the locking claw 30*a*. As shown in FIG. 1, the waste toner container 14 has at an end thereof protrusions 14*a* at which the waste toner container 14 engages the container drive gear 31 and receives a rotation force.

As shown in FIGS. 1 and 3, the drive frame 20 is provided with a detection switch 33 as detecting means whose switching arm touches the drive coupler 22*a*.

Next, the following description will discuss operations of the main parts of the copying machine having the foregoing arrangement.

Power, transmitted from the drive source 40 through the input gear 24 and the clutch section 22 to the screw drive gear 23, rotates the spiral transporting body 18 composed of the waste toner transporting screw 16 and the waste toner transporting spring 17. At the same time, the power transmitted from the drive source 40 to the screw drive gear 23 is also transmitted to the container drive gear 31 through the transmission gear 26, the rotation shaft 27 and the transmission gear 28.

As shown in FIG. 1, when the waste toner container 14 is loaded in a predetermined place, the protrusion 14*a* pushes the container drive gear 31 in the direction represented by the arrow X in FIG. 1 and moves the container drive gear 31 against a pushing force from the pushing spring 32. As the container drive gear 31 is moved by the protrusion 14*a*, the locking claw 30*a* of the fixed shaft 30 releases the rib 31*a* of the container drive gear 31 (See FIG. 4). As a result, the container drive gear 31 is released and becomes rotatable. In this case, the protrusion 14*a* of the waste toner container 14 is held by an area 34 composed by the rib 31*a* of the container drive gear 31 and thus fixed to the container drive gear 31. Therefore, the waste toner container 14 is rotated by the container drive gear 31.

As shown in FIG. 2, the remaining toner on a surface of the rotating photoreceptor drum 11 is swept down to the cleaning section 13 by the cleaning blade 12. As shown in FIG. 1, the waste toner in the cleaning section 13 is transported by the rotating spiral transporting body 18 through the waste toner transporting path 15 to the waste toner container 14, into which the waste toner is collected. As explained here, the waste toner is collected while the waste toner container 14 is rotating. The rotation of the waste toner container 14 scatters the waste toner uniformly in the waste toner container 14. Consequently, it is possible to effectively use the whole capacity of the waste toner container 14 to collect the waste toner.

On the other hand, as shown in FIGS. 3 and 4, when no waste toner container 14 is loaded, the container drive gear 31 is pushed by the pushing spring 32, and the rib 31*a* in the container drive gear 31 is locked by the locking claw 30*a* of the fixed shaft 30. As a result, the container drive gear 31 cannot rotate. Therefore, the transmission gears 28 and 26, and the screw drive gear 23 cannot rotate either. Besides, the driven coupler 22*b* of the clutch section 22 stops rotating. In this case, the drive coupler 22*a* receives a rotation force from the input gear 24 and is also pushed by the coupler spring 25. Thus the drive coupler 22*a* slides back and forth along the supporting shaft 21. The detection switch 33 is turned on and off repeatedly in response to the sliding movement of the drive coupler 22*a* and thus outputs a detection signal. On the basis of the detection signal, a necessary measure is taken: for example, a warning message is displayed, and/or the image forming apparatus device stops operations.

Meanwhile, when the waste toner container 14 is loaded, and the waste toner collecting operation progresses until the waste toner container 14 becomes full, the spiral transporting body 18 must bear an excessive burden. Then, as explained above, the driven coupler 22*b* of the clutch section 22 stops rotating. The driver coupler 22*a* is pushed by the coupler spring 25 and therefore slides back and forth along the supporting shaft 21. The detection switch 33 is then turned on and off repeatedly in response to the sliding movement of the drive coupler 22*a* and thus outputs a detection signal. On the basis of the detection signal, a necessary measure is taken as explained above: for example, a warning message is displayed, and/or the image forming apparatus device stops operations.

Figure 5:
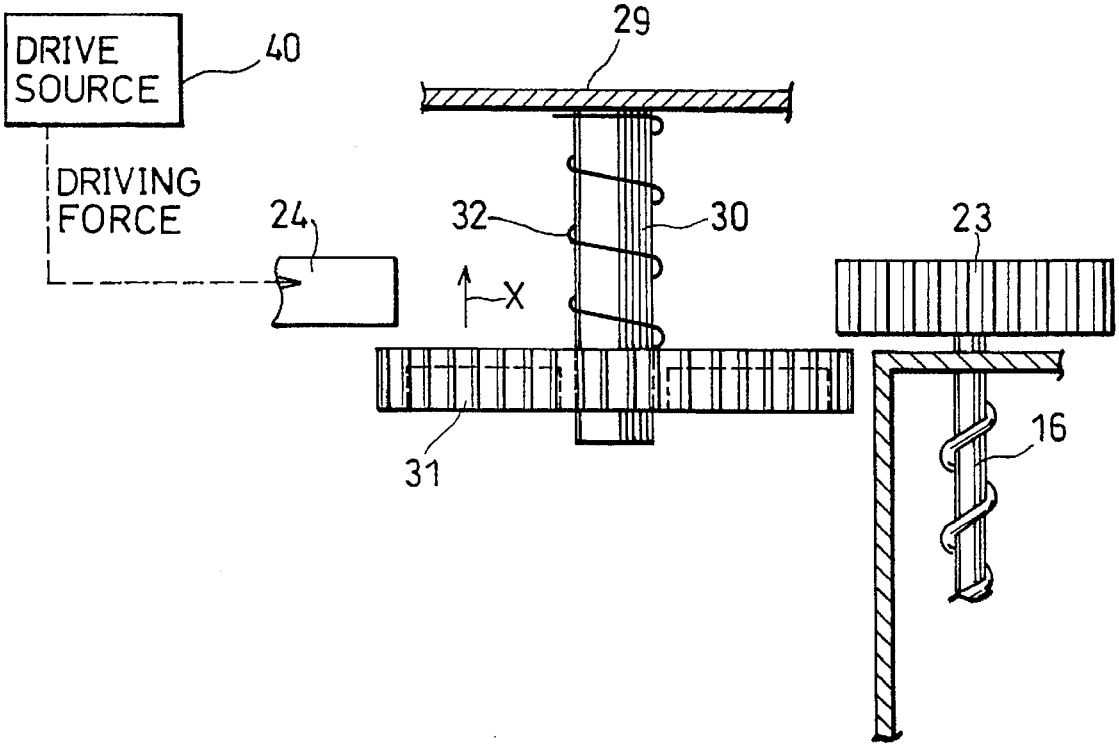
FIG. 5 is a schematic plan view showing an arrangement of main parts of an image forming apparatus of an another embodiment in accordance with the present invention.

Next, the following description will discuss an arrangement and operations of main parts of an image forming apparatus of another embodiment in accordance with the present invention. FIG. 5 is a plan view showing the main parts.

A container drive gear 31 is provided to freely rotate around and slide back and forth along a fixed shaft 30 fixed to and protruding from a frame 29. The fixed shaft 30 is provided with a pushing spring 32 therearound. The pushing spring 32 pushes the container drive gear 31 in the direction opposite from the direction represented by the arrow X in FIG. 5.

When no waste toner container 14 is loaded, the container drive gear 31 is pushed by the pushing spring 32 and therefore stays away from a screw drive gear 23 and an input gear 24 which is connected to a drive source 40. Thus, when no waste toner container 14 is loaded, the screw drive gear 23 is not driven and a spiral transporting body 18 does not rotate. Waste toner in a cleaning section 13 is therefore not transported to a waste toner transporting path 15. Consequently, it is possible to prevent the waste toner from falling into a loading place of the waste toner container 14 and making inside of a waste toner collecting device dirty.

On the other hand, when the waste toner container 14 is loaded in the predetermined place, the protrusion 14*a* pushes the container drive gear 31 in the direction represented by the arrow X in FIG. 5. As the container drive gear 31 slides along the fixed shaft 30, the container drive gear 31 comes in mesh with the screw drive gear 23 and the input gear 24. Therefore, power from the drive source 40 is transmitted to drive the container drive gear 31 to rotate and the screw drive gear 23. Consequently, it is possible to transport the waste toner through the spiral transporting body 18 and collect the waste toner in the waste toner container 14 while rotating the waste toner container 14.

Explanation is omitted about the same arrangement and operations of the present embodiment as those of the previous embodiment.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

a waste toner container capable of being provided in a predetermined place;

a drive source;

a drive mechanism, driven by said drive source, for driving said waste toner container to rotate;

a locking mechanism for locking said drive mechanism not to drive said waste toner container by a mechanical self-operating system without using a signal when no waste toner container is provided in the predetermined place, and for releasing and thus allowing said drive mechanism to drive said waste toner container by a mechanical self-operating system without using a signal when said toner container is provided in the predetermined place; and detecting means for outputting a detection signal upon locking a driving operation of said drive mechanism by said locking mechanism.

2. The image forming apparatus as defined in claim 1, wherein said detecting means includes a responding mechanism, connected to said drive mechanism, for responding when said locking mechanism locks said drive mechanism not to drive said waste toner container.

3. The image forming apparatus as defined in claim 2, wherein said responding mechanism includes:

a clutch member having a drive coupler driven to rotate by said drive source, and a driven coupler connected to said drive mechanism, the drive coupler and the driven coupler staying in mesh with each other; and moving means for moving the drive coupler away from the driven coupler when said drive mechanism is locked and stopped, and said detecting means includes a detecting switch which functions in accordance with a movement of said drive coupler.

4. The image forming apparatus as defined in claim 3, wherein said moving means includes:

a supporting shaft for supporting said drive coupler so that said drive coupler can rotate freely around and move along said supporting shaft; and a pushing member for pushing said drive coupler towards said driven coupler.

5. An image forming apparatus as defined in claim 1, further comprising:

a transporting mechanism for transporting waste toner to said waster toner container said detecting means includes a response mechanism for responding when said locking mechanism locks said drive mechanism against driving of said waste toner container, and for responding when torque, required for transporting the waste toner to said waste toner container by said transporting mechanism, is not less than a predetermined value, wherein said detecting means outputs the detection signal when a response is made by said response mechanism.

6. The image forming apparatus as defined in claim 5, wherein both said transporting mechanism and said drive mechanism are driven by said drive source, which serves to drive both mechanisms.

7. An image forming apparatus, comprising:

a waste toner container capable of being provided in a predetermined place;

a drive source;

a drive mechanism, driven by said drive source, for driving said waste toner container to rotate;

a locking mechanism for locking said drive mechanism against driving of said waste toner container when no waste toner container is provided in the predetermined place, and for releasing and thus allowing said drive mechanism to drive said waste toner container when said toner container is provided in the predetermined place; and detecting means for outputting, in response to said locking mechanism, a detection signal which varies, depending upon whether said waste toner container is provided in the predetermined place;

wherein said locking mechanism is pushed into a locking position for locking said drive mechanism against driving of said waste toner container when no waste toner is provided, and is pushed by said waste toner container into a position for releasing said drive mechanism, and thus allowing said drive mechanism to drive said waste toner container, when said waste toner container is provided in the predetermined place.

8. The image forming apparatus as defined in claim 7, wherein said drive mechanism includes a container drive gear, driven by said drive mechanism, for driving said waste toner container to rotate, and said container drive gear engages with and is locked by said locking mechanism not to drive said waste toner container to rotate when no waste toner container is provided, and is pushed by an end of said waste toner container to be released from said locking mechanism and to be thus allowed to drive said waste toner container to rotate when said waste toner container is provided in the predetermined place.

9. The image forming apparatus as defined in claim 8, wherein said locking mechanism includes:

a supporting shaft, passing through a center of said container drive gear, for supporting said container drive gear so that said container drive gear can rotate freely around and move along said supporting shaft;

a locking claw, provided around an end of said supporting shaft, for engaging with a part of surface of said container drive gear, the surface being in a radial direction of said container drive gear; and a pushing member for pushing said container drive gear towards said locking claw.

10. The image forming apparatus as defined in claim 9, wherein said pushing member is a spring provided around said supporting shaft.

11. The image forming apparatus as defined in claim 9, wherein said waste toner container includes a protrusion for pressing said container drive gear against a pushing force from said pushing member so that said container drive gear releases and thus allows said drive mechanism to drive said waste toner container, and for engaging with the surface of said container drive gear, the surface being in the radial direction of said container drive gear, and thus receiving a rotation force when said waste toner container is provided in the predetermined place.

12. The image forming apparatus as defined in claim 6, wherein the surface of said container drive gear which is in the radial direction of said container drive gear is provided with a rib member for engaging with said locking claw and for forming an area with which said protrusion engage.

13. An image forming apparatus, comprising:

a waste toner container capable of being provided in a predetermined place;

a drive source;

a drive mechanism, driven by said drive source, for driving said waste toner container to rotate;

a locking mechanism for locking said drive mechanism against driving of said waste toner container when no waste toner container is provided in the predetermined place, and for releasing and thus allowing said drive mechanism to drive said waste toner container when said toner container is provided in the predetermined place; and detecting means for outputting, in response to said locking mechanism, a detection signal which varies, depending upon whether said waste toner container is provided in the predetermined place;

a transporting mechanism for transporting waste toner to said waster toner container;

said detecting means includes a response mechanism for responding when said locking mechanism locks said drive mechanism against driving of said waste toner container, and for responding when torque, required for transporting the waste toner to said waste toner container by said transporting mechanism, is not less than a predetermined value, wherein said detecting means, in accordance with said responding mechanism, detects that no waste toner is provided, and that amount of waste toner in said waste toner container has reached predetermined amount, and thus outputs a detection signal in accordance with the amount of the waste toner in said waste toner container;

wherein said response mechanism includes:

a clutch member having a drive coupler driven to rotate by said drive source and a driven coupler connected to said drive and transporting mechanisms, the drive coupler and the driven coupler staying in mesh with each other; and moving means for moving the drive coupler away from the driven coupler both when said drive mechanism is locked and stopped, and when the torque required for transporting the waste toner is not less than the predetermined value, and said detecting means includes a detecting switch turned on/off by a movement of the drive coupler.

14. The image forming apparatus as defined in claim 13, wherein said moving means includes:

a supporting shaft for supporting said drive coupler so that said drive coupler can rotate freely around and move along said supporting shaft; and a pushing means for pushing said drive coupler towards said driven coupler.

15. An image forming apparatus, comprising:

a waste toner container capable of being provided in a predetermined place;

at least one drive source;

a transporting mechanism, driven by said drive source, for transporting waste toner to said waste toner container;

a drive mechanism, driven by said drive source, for driving said waste toner container to rotate;

a locking mechanism for locking said drive mechanism not to drive said waste toner container when no waste toner container is provided in the predetermined place;

a responding mechanism for responding both when said locking mechanism locks said drive mechanism not to drive said waste toner container and when torque required for transporting the waste toner to said waste toner container by said transporting mechanism is not less than a predetermined value; and detecting means, in accordance with said responding mechanism, for detecting that no waste toner container is provided, and that amount of the waste toner in said waste toner container has reached predetermined amount.

16. The image forming apparatus as defined in claim 15, wherein both said transporting mechanism and said drive mechanism are driven by said drive source, which serves to drive both mechanisms.

17. An image forming apparatus, comprising:

a waste toner container capable of being provided in a predetermined place;

a drive source;

a transporting mechanism, driven by said drive source, for transporting waste toner to said waste toner container;

a drive mechanism, driven by said drive source, for driving said waste toner container to rotate;

a locking mechanism for locking said drive mechanism against driving of said waste toner container by a mechanical self-operating system without using a signal when no waste toner container is provided in the predetermined place, and for releasing said drive mechanism, and thus allowing said drive mechanism to drive said waste toner container, by a mechanical self-operating system without using a signal when said waste toner container is provided in the predetermined place; and a linkage mechanism, interlocked with said locking mechanism, for locking said transporting mechanism against transporting of the waste toner when said locking mechanism locks and stops said drive mechanism, and for releasing said transporting mechanism, and thus allowing said transporting mechanism to transport the waste toner, when said locking mechanism releases and thus allows said drive mechanism to drive said waste toner container.

18. The image forming apparatus as defined in claim 17, wherein said linkage mechanism includes drive force cutoff means for cutting off transmission of a drive force from said drive source to said transporting mechanism when said drive mechanism is locked not to drive said waste toner container.

19. The image forming apparatus as defined in claim 18, wherein said drive force cutoff means includes:

a clutch member having a drive coupler driven to rotate by said drive source, and a driven coupler connected to both said drive mechanism and said transporting mechanism, the driven coupler transmitting the drive force from the drive source to both said drive mechanism and said transporting mechanism, the drive coupler and the driven coupler staying in mesh with each other; and moving means for moving the drive coupler away from the driven coupler when the driven coupler is not rotating, and said driven coupler stops rotating by said drive mechanism locked not to drive said waste toner container.

20. An image forming apparatus, comprising:

a waste toner container capable of being provided in a predetermined place;

a drive source;

a transporting mechanism, driven by said drive source, for transporting waste toner to said waste toner container;

a drive mechanism, driven by said drive source, for driving said waste toner container to rotate;

a locking mechanism for locking said drive mechanism against driving of said waste toner container when no waste toner container is provided in the predetermined place, and for releasing said drive mechanism, and thus allowing said drive mechanism to drive said waste toner container, when said waste toner container is provided in the predetermined place; and a linkage mechanism, interlocked with said locking mechanism, for locking said transporting mechanism against transporting of the waste toner when said locking mechanism locks and stops said drive mechanism, and for releasing said transporting mechanism, and thus allowing said transporting mechanism to transport the waste toner, when said locking mechanism releases and thus allows said drive mechanism to drive said waste toner container;

and wherein said drive mechanism includes:

a container drive gear, driven by said drive source, for driving said waste toner container to rotate and said linkage mechanism includes:

an input gear driven by said drive source to rotate;

a transporting mechanism drive gear connected to said transporting mechanism; and moving means for keeping said container drive gear in a place where said container drive gear does not come into engagement with said input gear when no waste toner container is provided in said predetermined place, and for moving said container drive gear, pushed by said waste toner container, to a place where said container drive gear comes into engagement with both said input gear and said transporting mechanism when said waste toner container is provided in said predetermined place.

21. The image forming apparatus as defined in claim 20, wherein said moving means includes:

a supporting shaft, provided to pass through a center of said container drive gear, for supporting said container drive gear so that said container drive gear can rotate freely and move along said supporting shaft; and a pushing member for pushing said container drive gear away from said input gear.

22. The image forming apparatus as defined in claim 21, wherein said pushing member is a spring provided around said supporting shaft.

* * * * *